US005533428A

United States Patent [19]

Pradelski

[11] Patent Number: 5,533,428

[45] Date of Patent: Jul. 9, 1996

[54] RATCHETABLE OPEN-ENDED WRENCH

[76] Inventor: William M. Pradelski, 11548 S. Brightway, Mokena, Ill. 60448

[21] Appl. No.: 343,238

[22] Filed: Nov. 21, 1994

[51] Int. Cl.[6] ..... B25B 13/12

[52] U.S. Cl. ..... 81/179; 81/186

[58] Field of Search ..... 81/179, 186, 119

[56] References Cited

U.S. PATENT DOCUMENTS

| | | | |
|---|---|---|---|
| 1,308,440 | 7/1919 | Morrison | 81/179 |
| 2,730,000 | 1/1956 | Crittenden . | |
| 2,910,902 | 11/1959 | Akers . | |
| 2,937,551 | 5/1960 | Akers | 81/179 |
| 3,023,654 | 3/1962 | Stambaugh et al. . | |
| 3,165,015 | 1/1965 | Hinrichs . | |
| 3,306,142 | 2/1967 | Buteau . | |
| 3,641,847 | 2/1972 | Horton | 81/179 |
| 3,717,054 | 2/1973 | Thompson . | |
| 3,881,377 | 5/1975 | Evans et al. | 81/186 |
| 4,440,047 | 4/1984 | Robbins . | |
| 4,637,284 | 1/1987 | Rosenbaum . | |
| 4,787,277 | 11/1988 | Myers . | |
| 4,889,020 | 12/1989 | Baker | 81/119 |
| 5,131,312 | 7/1992 | Macor | 81/119 |

*Primary Examiner*—Bruce M. Kisliuk
*Assistant Examiner*—Joni B. Danganan
*Attorney, Agent, or Firm*—Willian Brinks Hofer Gilson & Lione

[57] ABSTRACT

A wrench allows the user to apply sequential strokes to a rotatable element such as an hexagonal nut or bolt without removing the wrench from the element_. The wrench has a head with two jaws adapted to engage the rotatable element. A spring-mounted, retractable jaw member is linearly slidable within a slot in one of the jaws and biased toward the base of the wrench head. The retractable jaw member also has an exposed engaging surface on one side. The opposing jaw has another fixed engaging surface extending substantially parallel to the engaging surface on the retractable jaw member. The two engaging surfaces cooperate to grip a rotatable element and apply torque to the element to rotate it in one direction. On the return stroke, a relatively small amount of resistance from the rotatable element forces the retractable jaw member inward into its slot, allowing the wrench to rotate back around the element without turning it in the reverse direction.

17 Claims, 2 Drawing Sheets

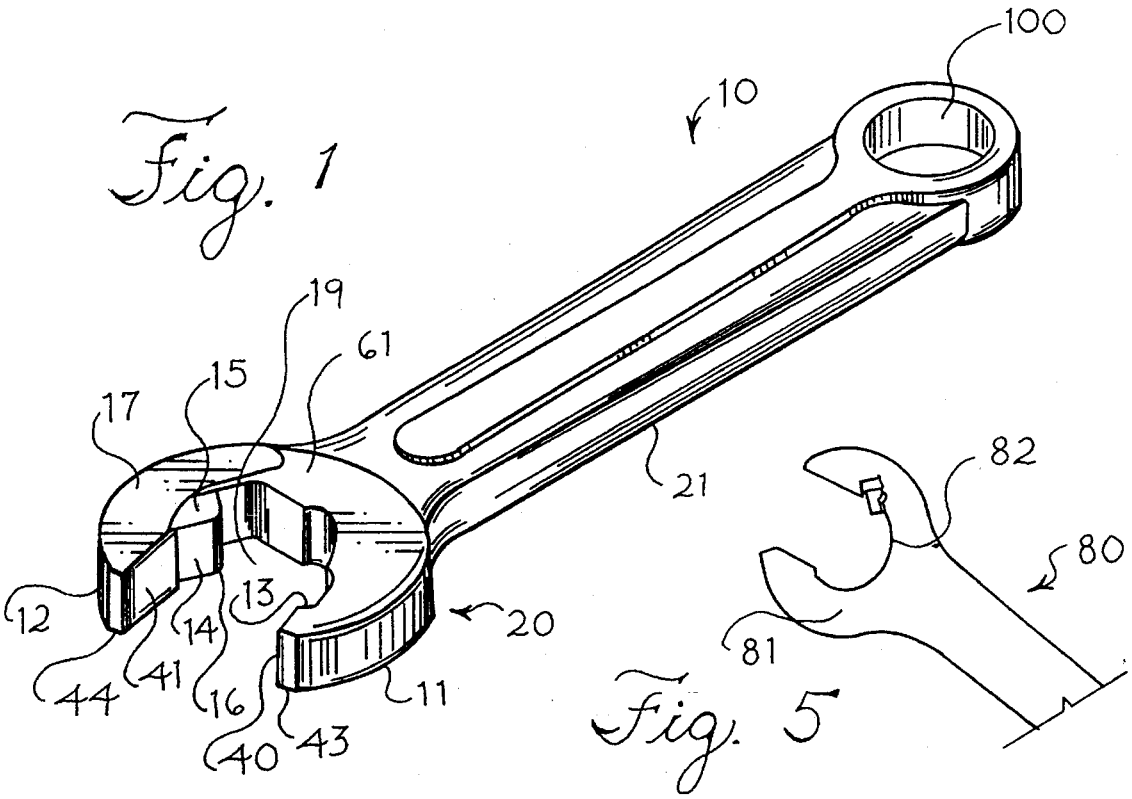
Fig. 1
Fig. 5
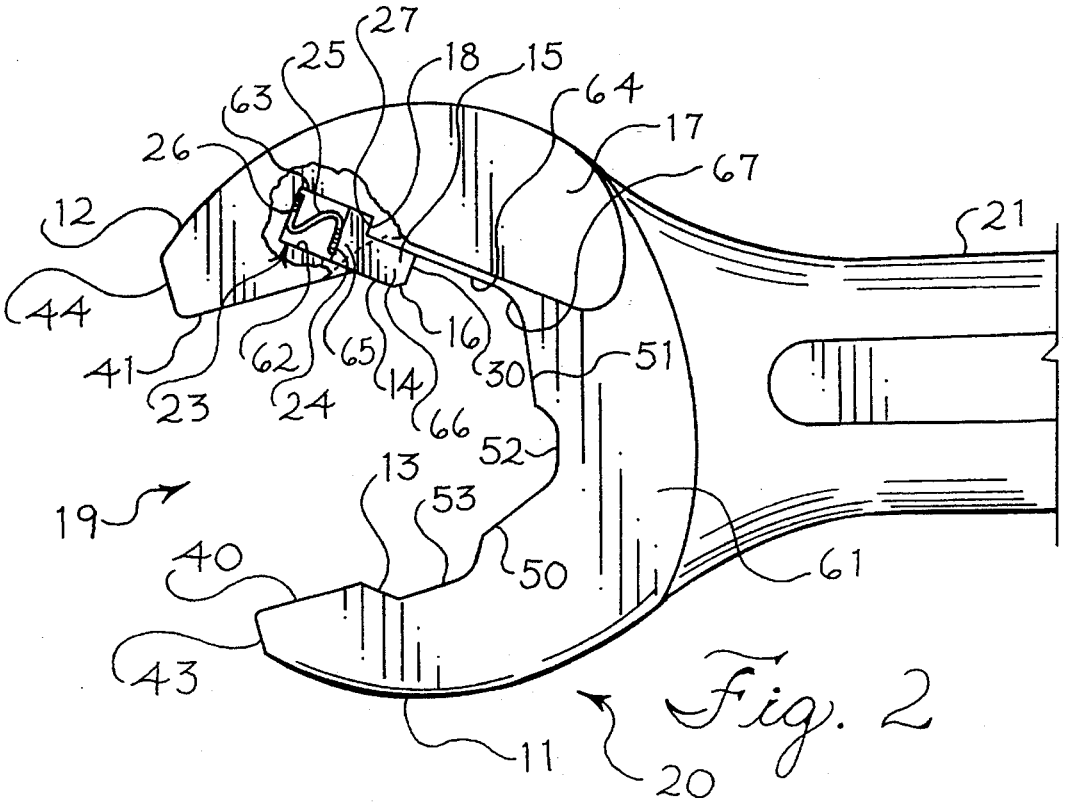
Fig. 2

RATCHETABLE OPEN-ENDED WRENCH

FIELD OF THE INVENTION

This invention relates to open-ended wrenches, and more particularly to an open-ended wrench which is ratchetable upon engagement with an hexagonal nut or similar rotatable element.

BACKGROUND OF THE INVENTION

Open-ended wrenches have numerous applications wherever any rotatable element, such as an hexagonal nut or bolt, needs to be tightened or loosened. The open-ended variety is especially useful where tight spaces restrict the use of socket wrenches or other closed-end tools. The difficulty with these wrenches, however, is that when the user is using it to turn an element in anything but the most unrestricted of spaces, the wrench must be removed from the element and repositioned every fraction of a turn due to interference with other obstructions. Thus, without adequate space for a full 360° C. turn of the handle, multiple turning strokes must be applied, with repositioning necessary after each stroke. This shortcoming slows the rate at which the element is driven or loosened, making it difficult, and sometimes nearly impossible, to turn elements quickly in tight or awkward spaces.

To solve this problem, various inventors have developed open-ended wrenches with a ratcheting feature so that the removal and repositioning of the wrench is not necessary when applying multiple turning strokes. Some examples of such wrenches are disclosed in U.S. Pat. Nos. 2,730,000; 3,023,654; 3,165,015; 3,306,142; 3,717,054; 4,440,047; 4,637,284; and 4,787,277. In these wrenches, the ratcheting feature is usually implemented in a complicated mechanism on or within the jaws of the wrench.

These prior art devices also have other shortcomings. Most of them have a large number of moving parts which must be precisely machined and fitted within close tolerances. Due to these assembly and manufacturing complications, the cost of purchasing a ratchetable open wrench is substantially greater than the cost of a standard, non-ratchetable model. This cost is significantly multiplied when one recognizes that, since the sizes for such wrenches are fixed and non-adjustable, a user must purchase a large number of wrenches to make a useful and complete set. The large investment involved with more complicated models discourages popular use of these wrenches.

Moreover, the close tolerances and multiple moving parts required in the prior art wrenches causes the wrenches to be more delicate and susceptible to damage with routine use. The small parts can become misaligned or dented, rendering the wrench or its ratcheting mechanism useless. In light of the significant expense involved in making or purchasing such wrenches, their susceptibility to damage makes the wrenches very impractical.

SUMMARY OF THE INVENTION

The preferred embodiment of the invention described herein provides a new and useful open-ended wrench having a novel ratcheting mechanism and a minimum number of moving parts.

A ratcheting feature on the wrench allows it to turn rotatable elements such as hexagonal nuts or bolts with sequential strokes without removing the wrench from the element. By utilizing a single plunger-like ratcheting mechanism, the wrench of the present invention overcomes the complexities, delicateness, and expensiveness of prior art ratcheting wrenches. The wrench and its two moving parts can be machined relatively simply and for less expense.

Furthermore, the direction of the applied torque on the wrench is substantially perpendicular to the flat surface of the retractable jaw member, allowing much of the reactive torque force to be absorbed by the wrench jaw, as opposed to the more delicate parts of the ratcheting mechanism itself. This feature minimizes the possibility of breakage or other damage to the internal mechanism, thereby promoting long service life for the wrench.

As described in further detail below, the disclosed wrench has a head portion comprising two jaws with a substantially parallel inside face on each jaw, and a handle portion extending from the head portion. One jaw on the head portion has a fixed engaging surface extending obliquely to the plane of its inside face, and the other jaw has defined within it an elongated slat with one open end. A retractable jaw member is slidably mounted within the slot and biased toward the open end of the slot by a metal spring. The retractable member has an elongated portion which projects out of the slot towards the base of the head portion. The elongated portion also has an engaging surface which extends substantially parallel to the fixed engaging surface on the opposite jaw.

The opposed parallel engaging surfaces are adapted to grip parallel flat surfaces on an element such as an hexagonal nut. When the wrench is turned in a direction toward the closed end of the slot (the torque stroke), the retractable jaw member is urged against the jaw by one of the nut surfaces and becomes frictionally fixed in the projected position. The resulting fixed engaging surfaces of the wrench apply torque to the nut in a manner similar to a conventional, non-ratchetable open-ended wrench.

When the wrench is turned in the opposite direction on a return stroke, however, the force urging the retractable jaw member against the jaw is released. A slight amount of turning resistance in the nut will cause one of the flat surfaces on the nut to urge the retractable jaw member rearward into the slot. The retracted member allows clearance for the jaws of the wrench to rotate freely relative to the nut. This allows the wrench to be turned or "ratcheted" about the nut without causing the nut to turn in the reverse direction.

BRIEF DESCRIPTION OF THE DRAWINGS

FIG. 1 is a perspective view of a preferred embodiment of the ratchetable open-ended wrench of the present invention.

FIG. 2 is an enlarged top view of the wrench head portion of FIG. 1 with its side plate partially cut away to show the internal ratcheting mechanism of the wrench.

FIG. 5 is a side view of an alternative embodiment of the wrench of the present invention.

DETAILED DESCRIPTION OF THE PREFERRED EMBODIMENT OF THE INVENTION

Figure 3:
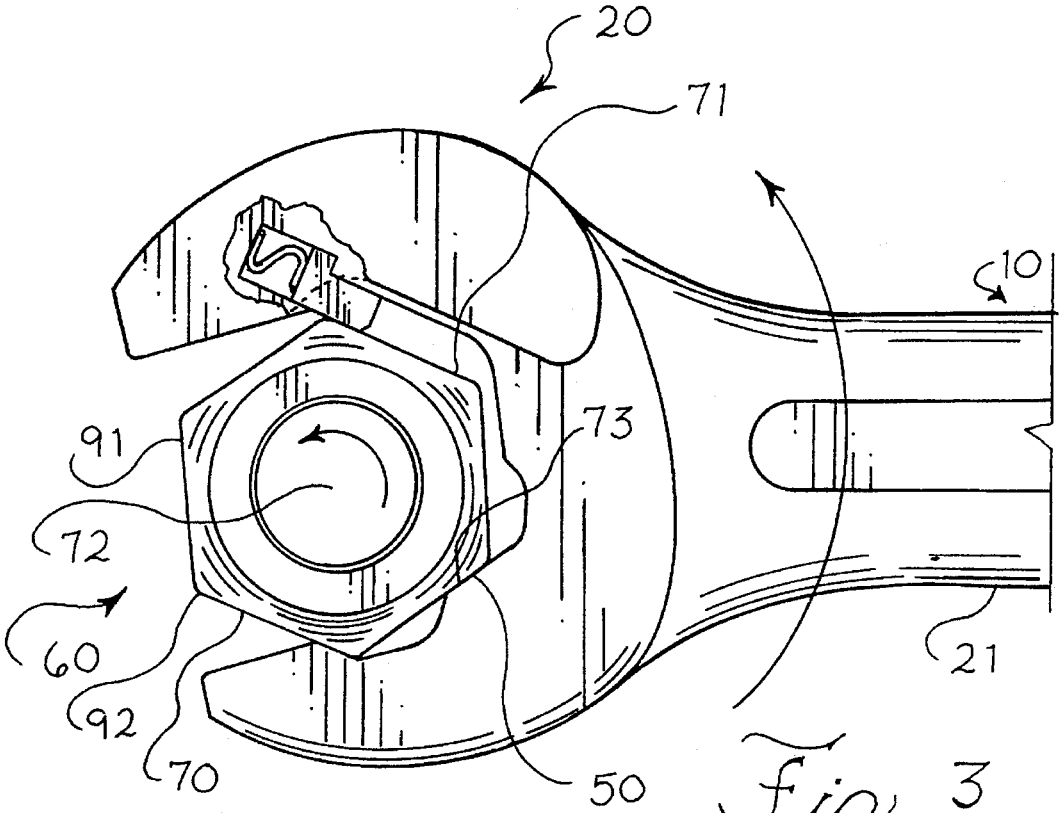
FIG. 3 is the wrench head portion of FIG. 2, further showing the wrench engaging and rotating a nut element.

Referring now to the drawings, the ratchetable open-ended wrench of the present invention is indicated generally at 10. The wrench comprises an elongated handle 21 and a head portion 20. Elongated handle 21 extends rearwardly from head portion 20 and is of a generally rectangular cross-section. Hanging ring 100 terminates the back end of handle member 21.

The head portion 20 is configured to engage and drive an hexagonal nut, bolt, or other rotatable element situated within gap 19. The open-ended configuration of the head portion 20 allows the wrench to engage an element, such as a nut, without covering the element.

As can be more easily seen in FIG. 2, head portion 20 comprises a base area 61 having a first jaw 11 and a second jaw 12 extending therefrom. The first jaw 11 has a flat inside face 40 and an engaging surface 13 oriented toward the base area 61. Engaging surface 13 extends at an obtuse angle to inside face 40. The second jaw 12 also has an inside face 41, which is substantially parallel to inside face 40 on the first jaw 11.

Adjacent the inside face 41 close to the base area 61 is an angled slot 23 defined within second jaw 12. The slot is of a generally rectangular cross-section having a first wall 62 substantially parallel to a second wall 63. The slot terminates at one end with a face 26 substantially perpendicular to first wall 62 and second wall 63. The opposite end of slot 23 opens into opening 19 within the head portion 20, and has a stop face 18.

A wall 64 extends from slot 23 towards base area 61 at an angle obtuse to inside face 41. The wall 64 is substantially parallel to the engaging surface 13 on the first jaw 11.

An L-shaped retractable jaw member 15 is slidably mounted within slot 23. The retractable jaw member 15 has a forward surface 30 and an engaging surface 14. The engaging surface 14 is substantially parallel to engaging surface 13 on the first jaw 11. Preferably, engaging surface 14 is positioned at an angle 143 degrees to inside face 41 of the second jaw 12. A chamfered edge 16 is provided between forward surface 30 and engaging surface 14. The chamfered edge 16 allows for improved ratchetability of the retractable jaw member 15.

The retractable jaw member 15 further comprises an elongated portion 66 and a detent portion 65. The elongated portion 66 has substantially parallel sides which slidably interface with the first and second walls 62, 63 of slot 23 and wall 64 to guide retractable jaw member 15 into and out of the slot 23. A spring 25, preferably made of metal, is mounted between the base 24 of the retractable jaw member 15 and face 26 of the slot 23 to bias the retractable jaw member 15 outward of the slot 23 into opening 19. Thus, the spring 25 normally maintains the retractable jaw member 15 in a projected position with the elongated portion 66 protruding into opening 19 towards base area 61.

Detent portion 65 has an inside edge 27 which contacts or abuts stop face 18 on the second jaw 12 when the jaw member 15 is in its "projected" position. This arrangement prevents the retractable jaw member 15 from being urged out of the slot 23. A metal cover plate 17 is provided on each side of slot 23 to encase the spring 25 and detent portion 65. Preferably, cover plates 17 are welded to head 20. The metal cover plates 17 protect the encased elements, preventing them from laterally falling out of slot 23, and preventing undue lateral movement of the retractable jaw member 15.

In order to provide more torquing surfaces, and to provide clearance for ratcheting around a rotatable element, head portion 20 is provided with various recesses, as hereinafter described. Unlike a conventional open-ended wrench, the parallel inside faces 40 and 41 on the first jaw 11 and second jaw 12, respectively, do not engage any part of a rotating element during use. The front portions of the first jaw 11 and second jaw 12, therefore, are flattened to resulting trimmed surfaces 43 and 44. This allows more clearance for the head portion 20 to fit into tight spaces and have the jaws 11 and 12 fully engaged around a rotating element. Recess 52 is defined on the base area 61 to provide clearance for the ratcheting action of the return stroke. Bearing surface 50 is positioned on one side of recess 52. Similarly, a recess 67 is provided at the juncture of wall 64 and the base wall 51. First jaw 11 also has a recess 53 on the inside portion of the jaw 11, partially defined by the engaging surface 13.

Preferably, the wrench 10 is forged from 4140 stainless steel. To provide necessary reasonably accurate tolerances and smooth surfaces for sustained and repeated use of jaw 15, an electric discharge machining (EDM) process is used to cut the slot 23 into the second jaw 12 and to create wall 64. Similarly, the recesses 51, 52 and 53 and the engaging surface 13 are machined using EDM. The retractable jaw member 15 is also machined using EDM, although 01 tool steel is most preferably used because of its superior strength. In the alternative, the entire wrench 10, including slot 23, may be manufactured using a forging process. Slot 23 can also be conventionally broached.

For a 13/16-inch wrench, the dimensions of the slot 23 and the retractable jaw member 15 are as follows (the thickness of the wrench is substantially uniform and a product of choice). The length of the first wall 62 of the slot 23 is 6.310 mm, the length of the second side wall 63 is 5.726 mm, and the face 26 is 4.060 mm. As for the retractable jaw member 15, the elongated portion 66 is 4.605 mm long, and the engaging surface 14 projects 4.015 mm out from wall 62, towards base area 61. The member 15 is 2.850 mm wide at forward surface 30, and the base 24 is 4.035 mm wide. Inside edge 27 is 1.715 mm thick and extends laterally into the slot 1.185 mm. The length of the inside face 41 of the second jaw 12 is 13.540 mm, and the length of the inside face 40 of the first jaw 11 is 8.195 mm. The engaging surface 13 on the first jaw 11 is 3.085 mm long and is positioned at an angle 143 degrees from inside face 40 (parallel to engaging surface 14). Bearing surface 50 is angled 157 degrees from inside face 40. The angle between base wall 51 and wall 64 is 120 degrees.

Figure 4:
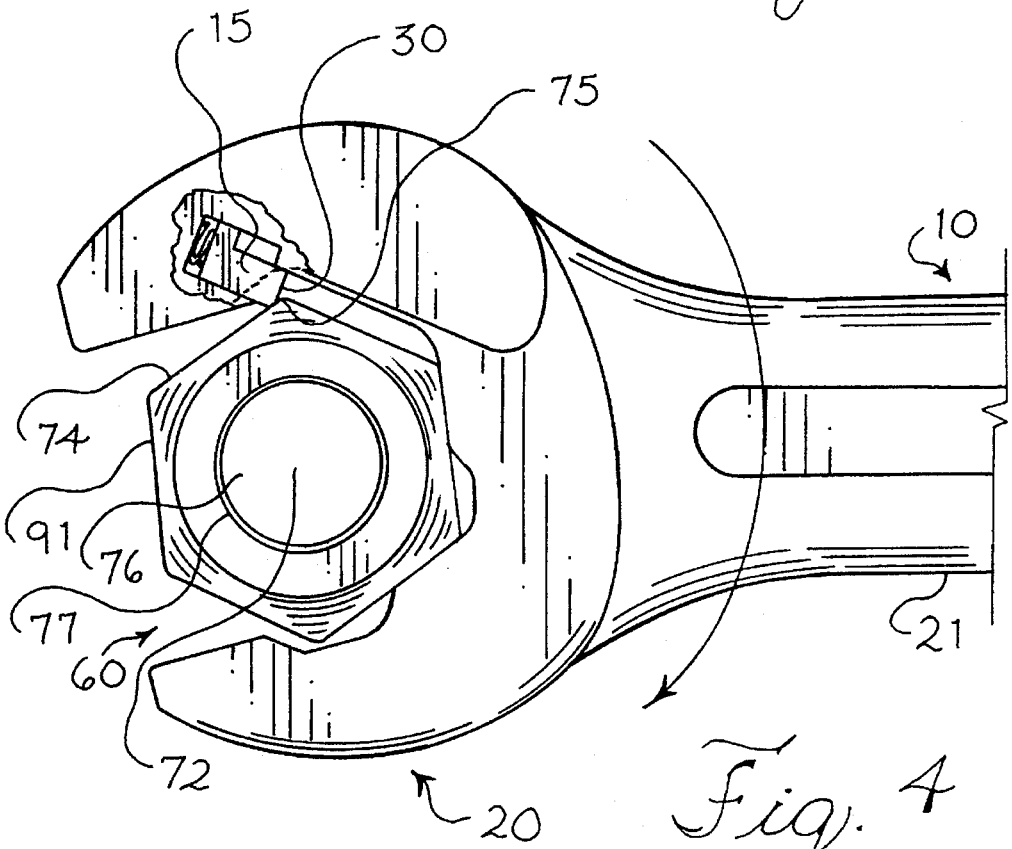
FIG. 4 is the wrench head portion of FIG. 3, showing the wrench rotating in the opposite direction and ratcheting with respect to the nut element.

The operation of the wrench 10 can be more readily seen in FIGS. 3 and 4. In particular, the turning (torque) stroke of an hexagonal nut 60 by the wrench 10 is shown in FIG. 3.

The nut 60 is threaded onto threaded bolt 76 (cross-section visible only) and is rotatable around axis 72. The nut 60 is surrounded circumferentially by six flat surfaces 91. When the first jaw 11 and second jaw 12 of head portion 20 are engaged around nut 60 for the torque stroke, opposed portions of flat surfaces 70 and 71 on nut 60 bear against the engaging surface 13 on first jaw 11 and the engaging surface 14 of the second jaw 12.

When force is applied to handle 21 so that the wrench 10 is turned counter-clockwise (specific to the orientation of the wrench in this Figure), torque is applied to nut 60 by the engaging surfaces 13 and 14. Preferably, a flat surface 73 adjacent to surface 70 on nut 60 is, engaged by an additional bearing surface 50 near the base area 61. The bearing surface 50 provides a further point for torque transmission to the nut 60.

The torque force is in a direction substantially perpendicular to the direction in which member 15 slides within the slot 23, so as to maximize the friction between elongated portion 66 and wall 64 and thereby hold the member 15 projected out of the slot 23 (i.e., into opening 19 and toward base area 61) and against wall 64. The retractable jaw member, therefore, being urged against wall 64 of second jaw 12, remains fixed against wall 64 during most of this stroke. The applied torque by surfaces 13, 14 and 50 causes the nut 60 to turn counter-clockwise (in this Figure) around axis 72.

Instead of bearing directly on the less durable internal surfaces and moving parts (as in the prior art) within slot 23, the force for torquing the nut 60 is absorbed perpendicularly to the retractable jaw member 15. Thus, the force is transferred laterally through the engaging surface 14 to wall 64 and into second jaw 12, and is subsequently absorbed by the base area 61 of the head portion 20. The flat-faced engaging surface 14 assures substantially lateral force transmission without undue stress urging retractable jaw member 15 out of slot 23. Likewise, the remaining portion of the torque force is absorbed by the opposing engaging surface 13, corresponding jaw 11, the base area 61, and bearing surface 50. The retractable jaw member 15 and the other internal parts of the ratcheting mechanism are therefore spared any undue stress and damage from normal use.

FIG. 4 shows the ratcheting mechanism of the wrench 10 in operation on the return stroke with the head portion engaged on an hexagonal nut 60. On the return stroke, force is applied to the handle 21 in the opposite direction, urging the wrench head portion 20 around axis 72 in the clockwise direction (in this Figure). When rotated in this direction, there are no flat engaging surfaces that can apply torque to any of the sides 91 of nut 60. The only substantial surface and notable resisting force is isolated at the forward surface 30 and chamfered surface 16 of the retractable jaw member 15. Flat surface 74 on nut 60, which is the closest surface to surface 30 and chamfered surface 16 in FIG. 4, forces the retractable jaw member 15 rearward into its slot 23. The corner 75 of nut 60 slides past the retracted jaw member 15, and the spring 25 returns the jaw member 15 to the projected position shown in FIGS. 1–3.

Chamfered edge 16 prevents the corner 75 of the nut 60 from catching on the retractable jaw member 15. Thus, the wrench in FIG. 4 can be turned clockwise without turning the nut 60 clockwise as well.

The ratcheting action of the retractable jaw member 15 continues in a similar fashion as the wrench handle 21 is turned clockwise around the nut 60. Once the handle 21 of the wrench 10 is in a satisfactory position for the application of another torque stroke, force may again be applied to handle 21 in the opposite direction. The retractable jaw member will again be locked in a projected position, and torque will be again applied to nut 60 via engaging surfaces 13 and 14. The clockwise and counter-clockwise movement of the handle 21 of wrench 10 may be continued until the tightening or loosening of the nut 60 is completed satisfactorily.

During the ratcheting stroke, a small amount of friction must be present between the rotatable element and its mating surface, sufficient to withstand the force required to retract jaw member 15. In this case, some friction must be present at the interface 77 between threaded bolt 76 and nut 60. In order for the ratcheting mechanism to work properly, the amount of friction that is present must be sufficient to urge the retractable jaw member 15 into the slot 23 without turning the nut 60. Some turning of the nut 60 in the direction of the return may occur if the friction is not sufficient. However, the ratcheting mechanism will still operate if this friction becomes sufficient as the speed of the reverse stroke is increased.

Note that in FIG. 4 the nut 60 is positioned snugly against the base area 61 and the base wall 51 during the return stroke. This positioning is important to allow the retractable jaw member 15 enough clearance to overcome the corners 92 of the nut 60. Similarly, during the remainder of the return stroke, a portion of the nut 60 should either remain substantially flush against the base wall 51 or substantially within recess 52. Thus, on the return stroke it is important for the user to urge the wrench slightly toward the bolt in a direction approximately parallel to the handle 21 while turning the wrench. This assures that the ratcheting action of the wrench proceeds smoothly and without turning the rotatable element.

In the alternative, the base area 61 of the wrench 10 may have a rounded surface instead of the various openings 52, 53, and surface 50. An embodiment of this wrench is shown in FIG. 5. The 7/16-inch wrench 80 in this figure has a base area 81 with a rounded surface 82 of radius 0.281 inches defined within it.

This invention should not be limited to the specific preferred embodiment described herein. In particular, the retractable jaw member of the present invention may be used on a closed-ended wrench as well as an open-ended wrench. Furthermore, the present invention can also be implemented on a crow's footstyle wrench head, which is a wrench head with a swivelable extension handle. Also, the invention may be implemented on an adjustable crescent-style wrench.

Of course, it should be understood that a wide range of changes and modifications can be made to the preferred embodiment described above. It is therefore intended that the foregoing detailed description be regarded as illustrative rather than limiting and that it be understood that it is the following claims, including all equivalents, which are intended to define the scope of this invention.

I claim:

1. A ratchetable wrench comprising:

a first jaw having a first inside face and a first non-movable engaging surface;

a second jaw having a first inside face and no more than one slot;

a base area connecting said jaws;

a retractable jaw member linearly slidable within said slot, having a second engaging surface substantially parallel to said first engaging surface on said first jaw, said retractable jaw member projecting toward said base area;

said first and second engaging surfaces adapted to engage a rotatable element having a plurality of circumferentially disposed flat surfaces.

2. A wrench according to claim 1 wherein said first engaging surface on said first jaw comprises a flat surface positioned at an angle obtuse to said first inside face.

3. A wrench according to claim 1 further comprising a spring to bias said retractable jaw member outward of said slot.

4. A wrench according to claim 1 wherein said jaw having trimmed surfaces on the front portions of said jaws.

5. A wrench according to claim 1 further comprising a series of recesses defined within said base area.

6. A wrench according to claim 5 further comprising a bearing surface defined within said base area to further engage said rotatable element.

7. A wrench according to claim 1 wherein said retractable jaw member is frictionally fixed against said second jaw by said rotatable element when said wrench is turned in a first direction.

8. A wrench according to claim 7 wherein said rotatable element is turned in said first direction when said wrench is turned in said first direction.

9. A wrench according to claim 8 wherein said retractable jaw member is urged into said slot by said rotatable element when said wrench is turned in a direction reverse to said first direction.

10. A wrench according to claim 9 further comprising one or more recesses defined within said base area to provide clearance for said rotatable element when said wrench is turned in a direction reverse to said first direction.

11. A ratchetable wrench comprising:

a head portion having a base area, a first jaw, and a second jaw;

said first jaw having an inside face and a first engaging surface, said engaging surface extending at an angle obtuse to said inside face;

said second jaw having an inside face and a single slot, said single slot defining an opening on said inside face;

a single retractable jaw member having an elongated portion and a substantially rectangular cross-section, said jaw member being linearly slidable within said single slot and having a second engaging surface extending parallel to said first engaging surface on said first jaw;

means for biasing said retractable jaw member so that said elongated portion extends toward said base area;

said first and second engaging surfaces adapted to engage a rotatable element having a plurality of circumferentially disposed flat surfaces, and said single retractable jaw member retractable into said single slot when said wrench is turned.

12. A wrench according to claim 11 wherein said means for biasing said retractable jaw member comprises a metal spring.

13. A wrench according to claim 11 further comprising means for limiting lateral movement of said retractable jaw member.

14. A wrench according to claim 13 wherein said means comprises a cover plate.

15. A wrench according to claim 11 further comprising means for limiting movement of said retractable jaw member outward of said slot.

16. A wrench according to claim 15 wherein said means for limiting movement of said retractable jaw member outward of said slot comprises a detent portion on said retractable jaw member.

17. A wrench according to claim 11 further comprising a series of recesses defined within said base area.

* * * * *